US005823856A

United States Patent [19]

Pallmann

[11] Patent Number: 5,823,856

[45] Date of Patent: Oct. 20, 1998

[54] APPARATUS FOR THE RESHARPENING OF TWO-DIMENSIONALLY ACTING KNIFE SETS FOR FLAKING MACHINES, ESPECIALLY FOR WOOD FLAKING MACHINES

[75] Inventor: Wilhelm Pallmann, Zweibruecken, Germany

[73] Assignee: Pallmann Maschinenfabrik GmbH & Co. KG, Zweibruecken, Germany

[21] Appl. No.: 787,964

[22] Filed: Jan. 23, 1997

[30] Foreign Application Priority Data

Feb. 12, 1996 [DE] Germany ..... 196 05 072.3

[51] Int. Cl.[6] ..... B24B 1/00

[52] U.S. Cl. ..... 451/45; 451/248; 451/229

[58] Field of Search ..... 451/45, 208, 209, 451/210, 224, 229, 234, 248, 398

[56] References Cited

U.S. PATENT DOCUMENTS

| | | | |
|---|---|---|---|
| 3,032,934 | 5/1962 | Johnsa | 451/45 |
| 4,583,574 | 4/1986 | Pallmann | 114/172 |
| 5,217,424 | 6/1993 | Pallmann | 483/1 |
| 5,283,986 | 2/1994 | Pozzo | 451/45 |
| 5,518,439 | 5/1996 | Lambertus | 451/45 |
| 5,525,094 | 6/1996 | Pallmann | 451/45 |

FOREIGN PATENT DOCUMENTS 2 066 729 7/1981 United Kingdom .

*Primary Examiner*—Eileen P. Morgan
*Attorney, Agent, or Firm*—Foley & Lardner

[57] ABSTRACT

The invention relates to the resharpening of two-dimensionally acting knife sets in knife rims as they are used for the industrial production of wood flakes from long logs and wood cut to length. Each knife set consists of a knife plate provided with a cutting edge and of several scoring organs whose scoring blades are tightly linked to the knife plate according to the invention. After having advanced all knife sets their resharpening is done in a first phase by means of a grinding drum provided with ring grooves while the knife rim is rotating slowly. In a second grinding phase the cutting edges are touched by the grinding drum which moves slightly in axial direction and for that purpose the knife rim is arrested intermittently. During this phase the residues remaining on the cutting edges and at the scoring organs in the area of the ring grooves are ground off.

Due to the present invention it is possible to resharpen the knife rims inside of the flaker via an automatic programmed control without loss of production and without the assistance of maintenance personnel so that the flaking operation is not interrupted and the knife sets are always perfectly sharp.

7 Claims, 5 Drawing Sheets

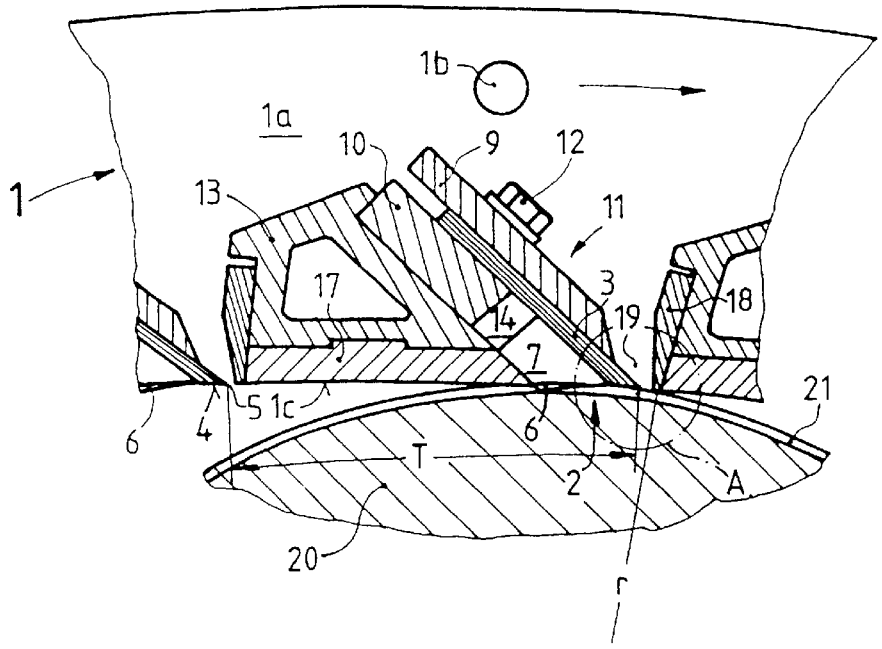
Fig. 1
Fig. 1A
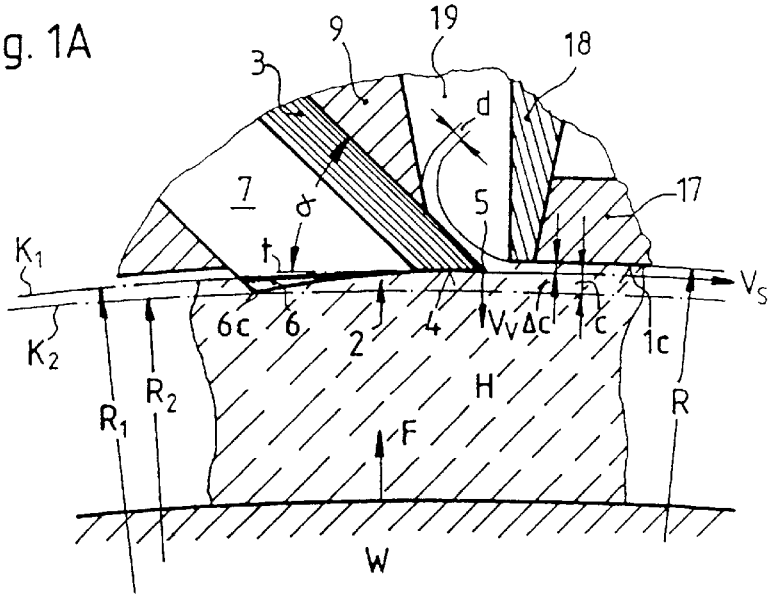
Fig. 2
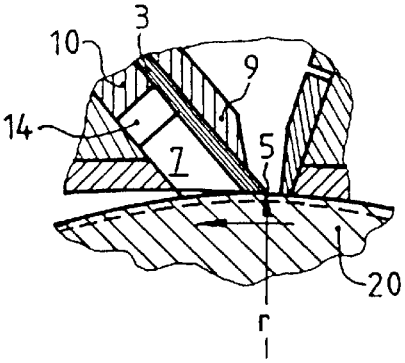
Fig. 3
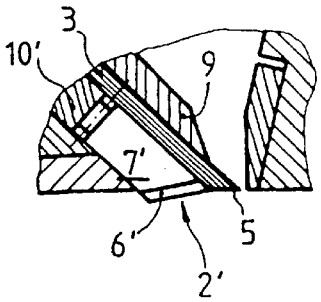

Fig. 4
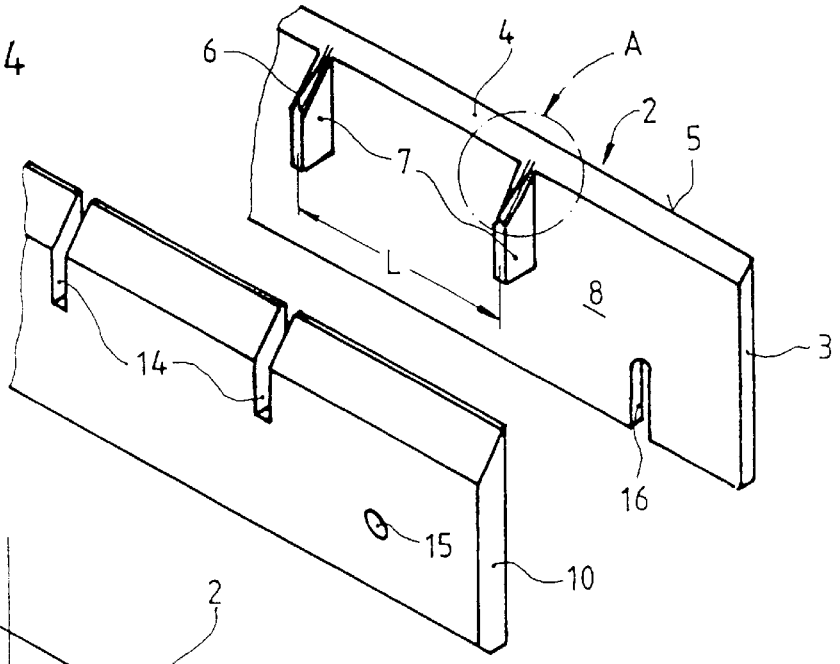
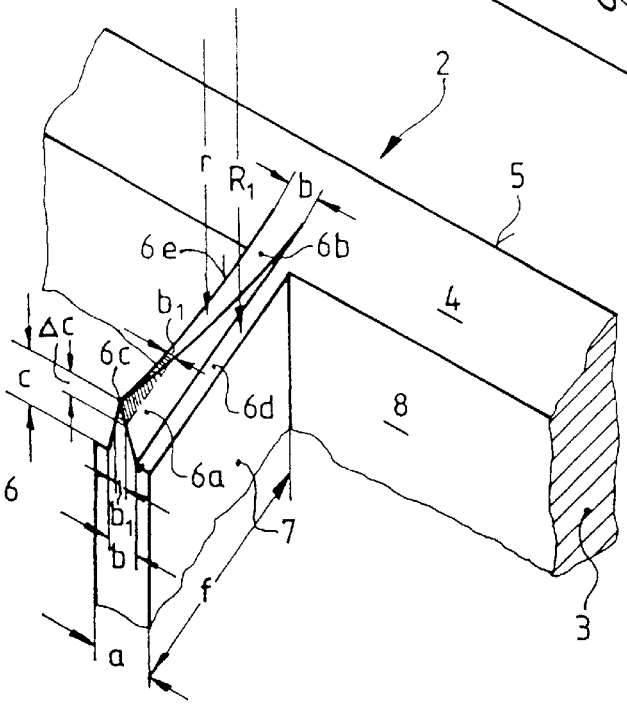
Fig. 4A
Fig. 5
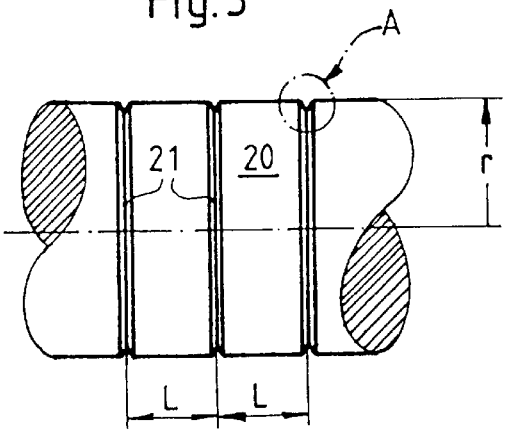
Fig. 5A
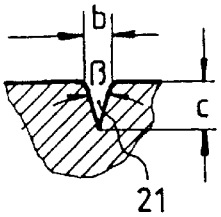

APPARATUS FOR THE RESHARPENING OF TWO-DIMENSIONALLY ACTING KNIFE SETS FOR FLAKING MACHINES, ESPECIALLY FOR WOOD FLAKING MACHINES

Apparatus for the resharpening of two-dimensionally acting knife sets for flaking machines, especially for wood flaking machines

FIELD OF THE INVENTION

The invention relates to a device for the resharpening of the two-dimensionally acting knife sets of flakers for the production of thin flakes from long wood and wood cut to length. The produced flakes are intended for the further processing into products, particularly for the construction industry on which there are made permanently growing demands regarding their quality, particularly their mechanical properties. Consequently the demands made on the quality of the flakes regarding their uniform dimensions, the structure of their surface and the accuracy of their edges are very high. To satisfy these high demands made on the quality of the flakes, the knife sets of the flakers must always work with cutting edges which are perfectly sharpened.

In the last decade knife rim flakers have shown to be most suitable for the flaking of long wood and wood cut to length. Such a flaker has been described for the first time in the U.S. Pat. No. 4,583,574 and consists essentially of a knife rim rotating inside of a machine housing. The wood to be flaked is placed into a feed trough and pushed cyclically into the interior of the knife rim which is moved cross to the feed trough for each flaking cycle.

The knife rim is equipped with plate-shaped flaking knives distributed on its periphery whereby the cutting edges are oriented to the inside and move along a common circle. Thereby the radial distance between cutting edges and cylindrical inner wall of the knife rim determines the thickness of the produced flakes which may be of 0.3 to 0.8 mm depending on the intended use. The length of the flakes along the grain of the wood is defined by the scoring organs allocated to the flaking knives in equal axial distances. The exact resharpening of these two-dimensionally acting knife sets kept in the knife rim is the object of the invention described hereafter.

BACKGROUND OF THE INVENTION

The cutting edges of the flaking knives are subject to enormous wear so that they last normally only a few hours, and therefore must be replaced by resharpened knives several times during a working shift what amounts to about a thousand knife changes a year. To minimize the downtime necessary for knife change, the complete knife rim is removed out of the flaker and immediately replaced by a knife rim with sharpened knives so that the operation may restart immediately after replacement of the knife rim. To carry out the knife rim replacement, the flaker is moved from its station of operation to its station of change provided alongside the feed trough as described in U.S. Pat. No. 4,583,574.

So the dull flaking knives can be removed from the demounted knife rim one by one and replaced by sharpened knives without impairing the flaking operation. When mounting the ground knives into the knife rim, their cutting edges must always show the same radial protrusion over the inner wall of the knife rim formed by the so-called wear shoes, said protrusion being decisive for the wanted thickness of the flakes. This requires a knife holding system making possible a setting of the sharpened cutting edges outside of the flaker by means of a special setting device. For this purpose it was the custom until now to attach each flaking knife in a removable manner to a holding plate with a reference surface that determines the protrusion of the cutting edge and which, in turn, contacted a corresponding reference surface provided on the knife supports of the knife rim during the installation of the knife set consisting of flaking knife and knife holding plate. While it is true that this allows a reproducible protrusion of the cutting edge against the original state of the cylindrical inner wall of the knife rim, what had not been considered however was the respective local wear condition at the wear shoes. Over a longer period of time this lead to a constant and finally no longer acceptable increase in the thickness of the flakes which were produced.

Furthermore during the frequent changes of knives, the handling of the heavy knife sets was not only cumbersome, tiresome and potentially injurious but also time consuming; this is true especially since the knives must first be removed from their holding plates before resharpening and then assembled again whereby their cutting edges must also be adjusted to the theoretical protrusion with regard to the before-mentioned reference surface provided on the holding plate.

To avoid these disadvantages many efforts have been made to facilitate the knife change and the adjustment of the cutting edges. The U.S. Pat. No. 5,217,424 has been granted to a method and apparatus for the automatic exchange of flaking knives wherein the dull flaking knives are removed one after the other out of the knife rim and deposited into a knife magazine from where immediately thereafter a resharpened knife can be taken and inserted into the knife rim. Thereby an adjusting device integrated in the exchange device cares for a protrusion of the cutting edge corresponding to the respective local wear condition of the knife rim.

A further improvement to facilitate the maintenance work required due to the rapid wear of the cutting edges is proposed in the U.S. Pat. No. 5,525,094 wherein the flaking knives remain in the knife rim during resharpening. For that purpose the resharpening of the dull flaking knives is done by grinding of the cutting edges while the knife rim is rotating slowly whereby the resharpening is carried out by means of a grinding wheel rotating within the knife rim and at the same time oscillating back and forth axially. For that purpose the knives must be loosened on their holders one after the other and advanced towards their area of function, that means to the inside, over a distance corresponding to the wear of the cutting edges, and then refastened. At the same time the degree of wear of the wear shoes in the respective area of the advanced knife is detected by sensors and an average value calculated for the pre-programming of the radial advancing of the grinding wheel which is of only a few tenths of a millimeter. These operations are carried out in a special device into which the knife rim is placed after having been removed from the flaker.

This device suitable e.g. for the resharpening of the flaking knives of knife rims for the flaking of wood chips, that means with cutting systems acting in one dimension, is not suitable without restrictions for the two-dimensionally acting cutting systems of knife rims as they are used e.g. for the flaking of long logs and wood cut to length. When the scoring organs are tightly fastened to the front side of the flaking knives, as it is e.g. known from the UK-Patent No. 20 66 729, the cutting edges of the flaking knives can be resharpened together with the scoring organs, but these scoring organs preceding the flaking knives present the great disadvantage that they produce grooves in the wood like a plow will do and thereby not only generate a lot of worthless fines but also flakes with lacerated edges. So the flakes tend to interlock and tangle during further processing and so impair the intended correct orientation which makes them unusable for the production of high quality flake products.

That is why knife rims with two-dimensionally acting knife sets will only meet to a certain extent the demands made nowadays on high quality flakes if the scoring organs penetrate into the wood with a drawing movement. This gentle scoring effect requires that the scoring organs follow the flaking knives in their arrangement on the knife rim. Due to their thereof resulting radial protrusion over the cutting edges of the flaking knives the sharpening device in question proposed for knife rims with cutting systems acting in one dimension is only usable if the scoring organs are excluded from the actual sharpening operation. This can be done so that the cutting edges of the flaking knives are pushed forward beyond the radial extent of the scoring organs and that they are fixed in that position before starting the resharpening of the cutting edges of the flaking knives as described above. After resharpening of the cutting edges the knife holders must be loosened again and the flaking knives must be pushed backward into their working position in which their cutting edges show the targeted protrusion above the inner wall of the knife rim which is done by means of the adjusting device.

But this simple resharpening operation has considerable disadvantages in multiple respects. Besides the fact that the operation sequence is cumbersome and time-consuming the scoring organs become more and more dull with each resharpening which in turn impairs the quality of the produced flakes. So already after a few resharpenings of the knife edges a cumbersome and time-consuming exchange of the scoring organs becomes necessary.

SUMMARY OF THE INVENTION

Accordingly it is an object of this invention to design the two-dimensionally acting knife sets with scoring organs following the flaking knives as well as the corresponding resharpening device so that the scoring organs are resharpened at the same time as the cutting edges of the flaking knives and that this can be done repeatedly in a manner accessible to an automatic programmed control.

Based on the sharpening apparatus proposed for knife rims with knife sets acting in one dimension as described in the U.S. Pat. No. 5,525,094, according to the present invention this task is solved by the fact that the axially equidistant scoring organs are part of the scoring blades which are tightly attached to the rear side of the plate-shaped flaking knife and that the grinding element of the sharpening apparatus consists of a grinding drum whose length corresponds to the length of the flaking knives and is provided with equidistant ring grooves with a profile matching the profile of the scoring organs.

These features bearing the essence of the invention make it possible to carry out the simultaneous resharpening of the flaking organs and scoring organs of a knife rim in two sharpening phases. During the first sharpening phase, the knife rim is rotating slowly and the grinding drum first grinds off at the face of the flaking knives and at the flanks of the scoring organs the thin layers corresponding to the knife protrusion due to wear. Then in the second sharpening phase the knife rim is stopped gradually and the slightly axially moving grinding drum grinds off the residues remaining on the cutting edge of the flaking knives in the area of the ring grooves and on the scoring organs. The second sharpening phase must be carried out for each knife set separately but considering the few tenths of a millimeter which have to be ground off and the small quantity of residues, only a short time is required.

As the interior of knife rims with two-dimensionally acting cutting system as they are used for the flaking of long logs and wood cut to length, is free of built-in-components it offers enough space for the insertion of the sharpening device. Consequently the resharpening can be carried out directly inside of the flaker. As already described in U.S. Pat. No. 4,583,574, for that purpose the flaker is moved sidewards from its position of operation in front of the feed trough into the position of change used now as station for sharpening equipped with the required tools for the step by step advancing of the flaking knives and for the sharpening and adjusting of the flaking knives as they are in principle already proposed for knife rims with cutting systems acting in one dimension in U.S. Pat. No. 5,525,094. In the station for sharpening, after the knife rim has been stopped, the sharpening device consisting of a grinding drum and an adjusting device is moved into the interior of the knife rim and at the same time access to the periphery of the knife rim is allowed to the setting apparatus for step by step advancing of the knife sets by opening a small door provided at the side of the machine housing.

During the time the knife sets are resharpened the flaker is not in operation and so the production is interrupted, but this downtime can be avoided due to a further development of the invention wherein a station for sharpening is provided on both sides of the feed trough and two similar flakers are installed on a common sliding platform. So one flaker is always in operation while the other gets serviced in one of the two sharpening stations. Finally, according to the invention, the repeating sharpening procedures can be carried out automatically, via an automatic programmed control, that means without the need of maintenance personnel. Thereby the automatic programmed control is started by the increased energy consumption of the drive motor of the knife rim caused by the dull knife sets.

So by taking advantage of all the features of the invention, a continuous flaking operation over quite a long period of time with best sharpened knife sets is possible and allows the production of a constant highest flake quality without needing intervention of maintenance personnel.

BRIEF DESCRIPTION OF THE DRAWINGS

The accompanying drawings illustrating possible embodiments of the invention show in

Figure 6:
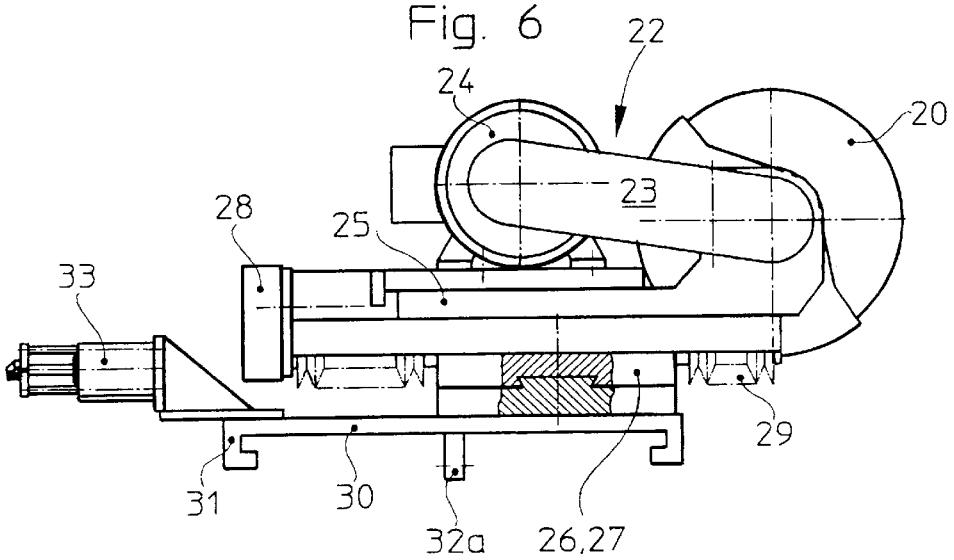

| | |
|---|---|
| FIG. 1 | a detail of the knife rim of a flaker with two-dimensionally acting knife set according to the invention during the sharpening procedure; |
| FIG. 1A | a detail of FIG. 1 on a larger scale illustrating the cutting geometry; |
| FIG. 2 | the same cutting system during the dressing; |
| FIG. 3 | the two-dimensionally acting knife set with State of the Art exchangeable scoring blade; |
| FIG. 4 | a perspective view of a knife plate with integrated scoring blades and corresponding guiding plate; |
| FIG. 4A | a detail of FIG. 4 on a much larger scale; |
| FIG. 5 | a grinding drum according to the invention; |
| FIG. 5A | a detail of FIG. 5 on a much larger scale; |
| FIG. 6 | a front view of the sharpening apparatus; |

-continued

Figure 7:
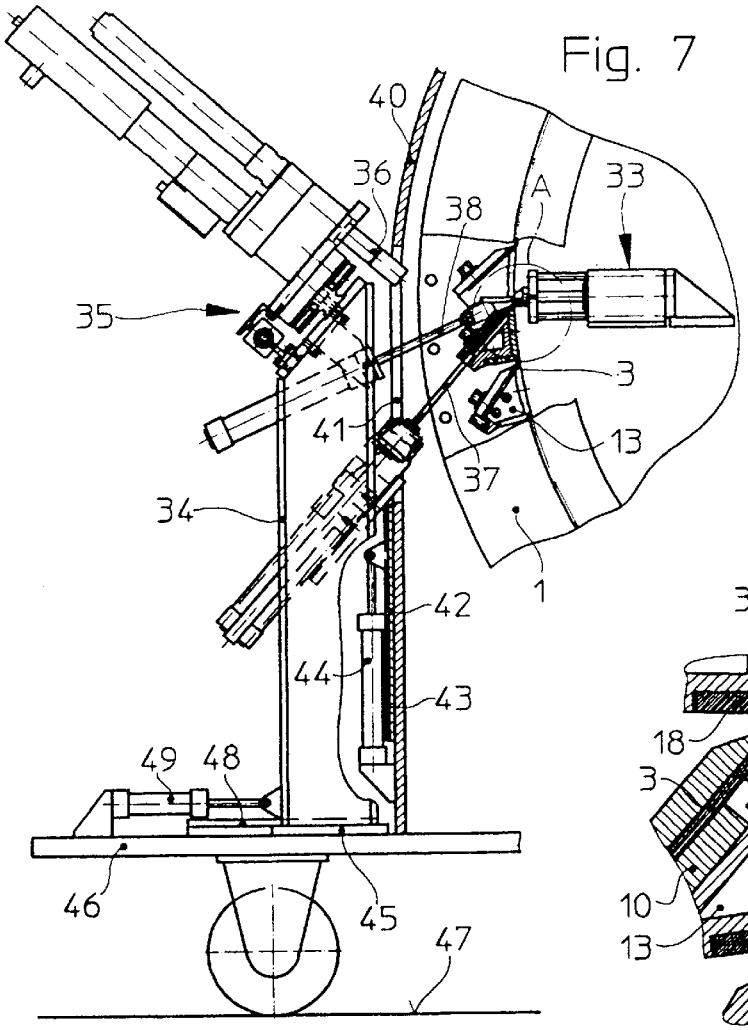
Figure 7A:
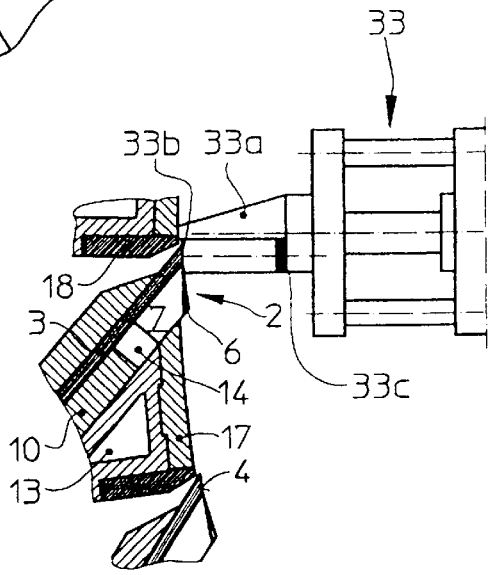
Figure 8:
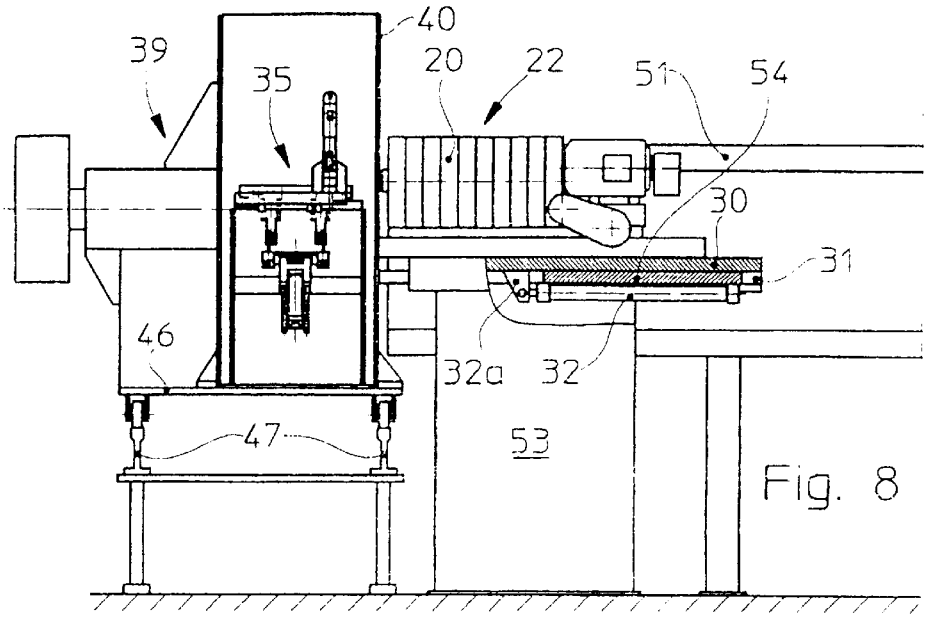
Figure 9:
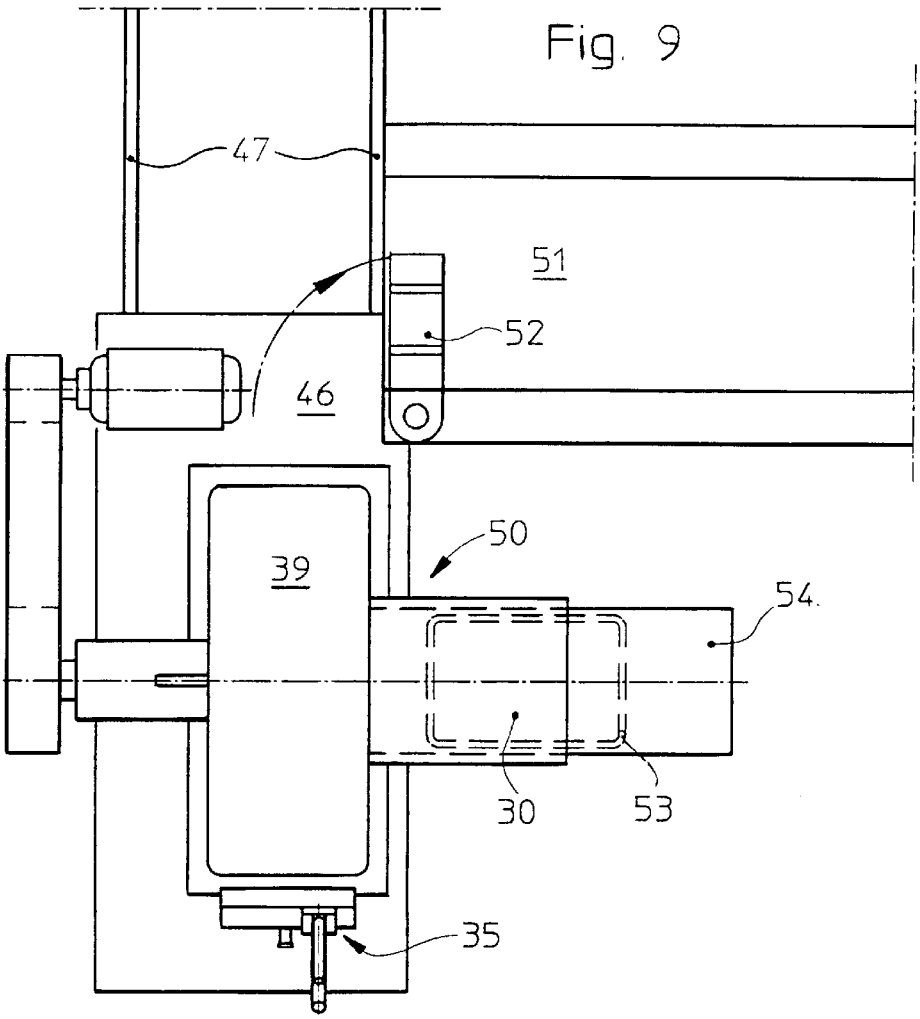
Figure 11:
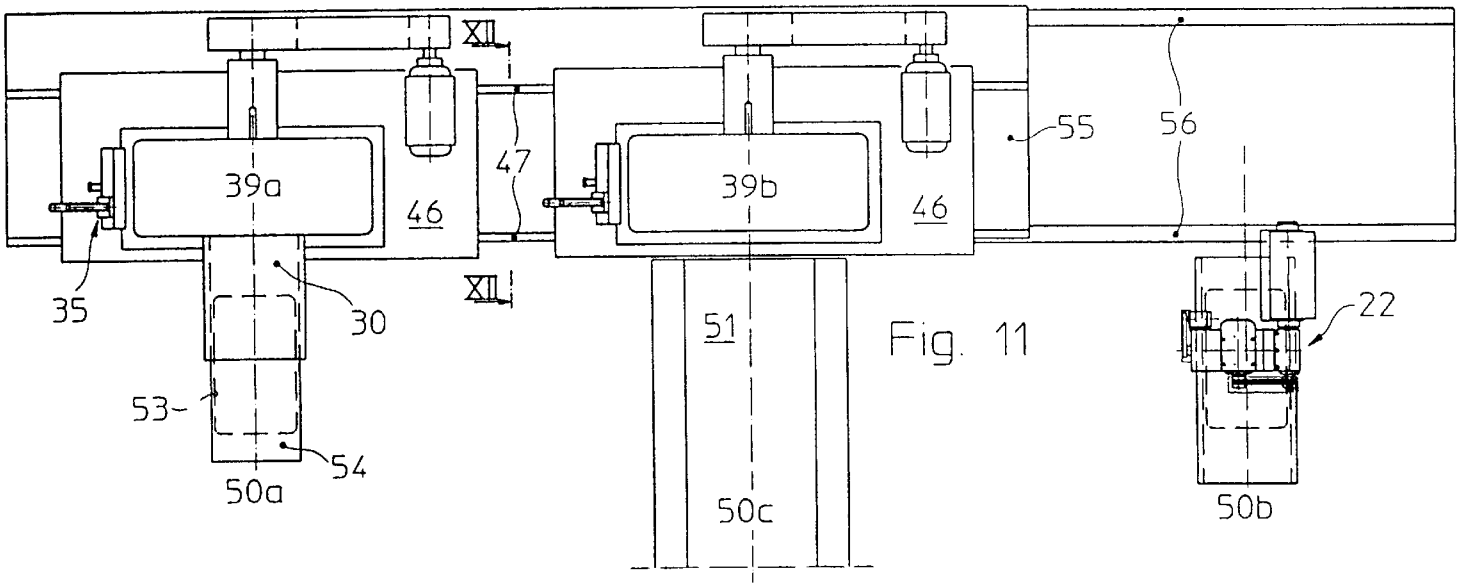
Figure 12:
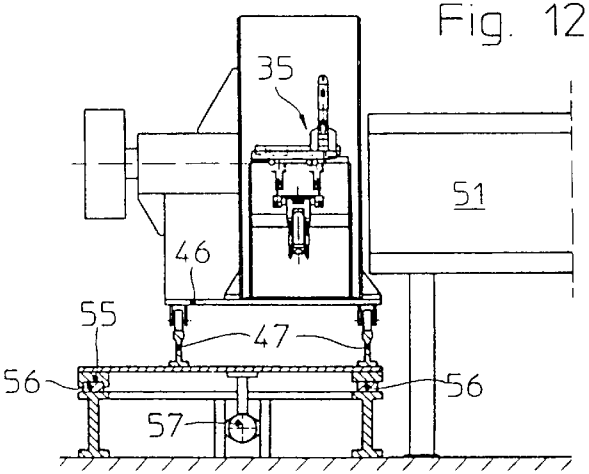
Figure 10:
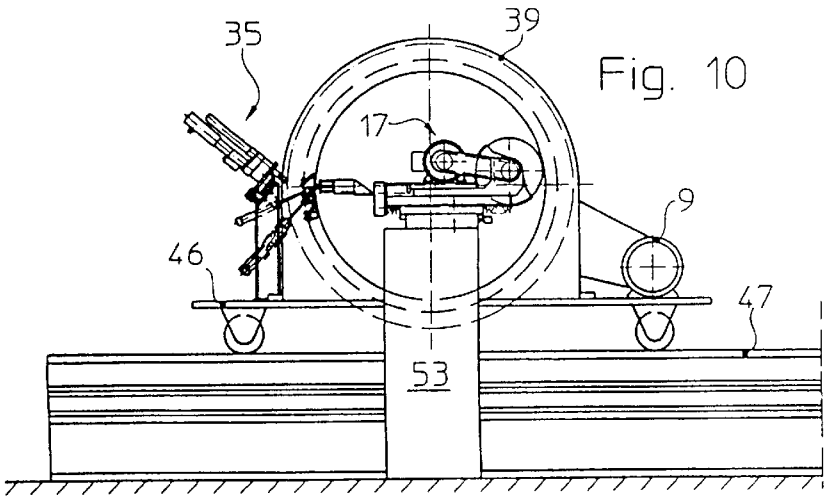

| | |
|---|---|
| FIG. 7 | a setting device to move the worn-out knife-sets forward; |
| FIG. 7A | a detail of FIG. 7 on a larger scale; |
| FIG. 8 | a side view of the station for sharpening according to the invention; |
| FIG. 9 | a plan view of the same station for sharpening; |
| FIG. 10 | a front view of the same sharpening station; |
| FIG. 11 | a flaking installation with two stations for sharpening; |
| FIG. 12 | a sectional view taken along line XII-XII of FIG. 11. |

DESCRIPTION OF THE PREFERRED EMBODIMENTS

A knife rim 1 shows several two-dimensionally acting knife sets 2 evenly distributed on its periphery at equal intervals T. One of these knife sets 2 is illustrated by FIG. 1A. Each knife set 2 consists of a knife plate 3 whose wood flaking cutting edge 5 is followed in the rotational direction of the knife rim 1 by several axially equidistant scoring organs 6. The scoring organs 6 are part of the scoring blades 7. As particularly obvious from FIG. 4, the scoring blades 7 are tightly fastened to the back 8 of the knife plate 3 at regular axial intervals L.

The knife sets 2 consisting of the knife plates 3 and the scoring blades 7 form with their holding plates 9 and their guiding plates 10 exchangeable units 11 which are fastened onto the knife carriers 13 by means of clamping screws 12 whereby the knife carriers 13 link the two outer rim discs 1*a* of the knife rim 1 together. In one of both rim discs 1*a* an arresting boring 1*b* is allocated respectively to each knife carrier 13. If required, a corresponding arresting bolt (not shown) can be slid into this boring 1*b* as it is useful e.g. during the resharpening procedure according to the invention and explained in the following.

As particularly illustrated by FIG. 4, each guiding plate 10 shows slits 14 for the scoring blades 7. Furthermore it is provided with borings 15 for the clamping screws 12. Correspondingly the knife plate 3 shows guiding slots 16 for the clamping screws 12, said slots allowing a pushing forward of the worn out knife sets 2 over a given distance before beginning of the actual sharpening procedure.

On the inside the knife carriers 13 are reinforced by means of wear shoes 17 which, taken as a whole, form the cylindrical inner wall 1*c* of the knife rim 1 having a radius R. A pressure lip 18 arranged opposed to the cutting edge 5 forms an essentially radial outlet gap 19 for the flakes peeled off from the wood and whose uniform thickness d is determined by the radial protrusion Δc of the knife cutting edges 5 over the cylindrical inner wall 1*c* of the knife rim 1 and whose uniform length is defined by the axial distances L of the scoring blades 7.

FIG. 1 illustrates the knife set 2 during the sharpening phase. During this phase the knife rim 1 rotates slowly in the direction shown by the arrow while a grinding drum 20 having a radius r rotates in the opposite direction and acts upon the faces 4 of the knife plate 3 thereby sharpening the cutting edge 5 of the knife plate. The length of the grinding drum 20 matches the axial length of the knife sets 2 and it is provided at equal intervals L with ring grooves 21 allowing a simultaneous grinding of the scoring organs 6 following the knife cutting edges 5.

FIG. 1A shows on a larger scale a detail of the knife set 2 illustrated by FIG. 1 and its working principle on the wood H to be flaked, whereby the wood is only represented symbolically in the drawing. Thereby the knife plate 3 is inclined by an angle of attack α with regard to the tangent t generated by its cutting edge 5.

When the knife rim 1 rotates, the knife sets 2 rotate at a cutting speed $v_s$ and consequently the cutting edges 5 are moving along a common circle $K_1$ having a radius $R_1$ and the scoring tips 6*c* of the scoring organs 6 are moving along a hereto concentric common circle $K_2$ having a radius $R_2$. The common circle $K_1$ of the cutting edge 5 shows a radial distance Δc=d with regard to the cylindrical inner wall 1*c* of the knife rim 1 having a radius R whereby the common circle $K_1$ is distant from the smaller common circle $K_2$ of the scoring tips 6*c* by the radial distance c. Due to this geometrical relationship the scoring organs 6 scratch a circular arc shaped separating groove into the wood H while the knife rim 1 is rotating stationary. The V-shaped profile of said separating groove has a max. width b and a constant depth c with regard to the common circle $K_1$ as well as a groove angle β (see hereto also FIGS. 4A and 5A).

When flaking the wood H the cutting speed $v_s$ is overriden by the considerably smaller advance speed $v_v$ at which the knife rim 1 moves towards a stationary wall W (retaining device 52 in FIG. 9) and where it generates a reaction force F with which the wood H is pressed against the inner wall 1*c* of the knife rim 1. Due to this speed overriding the scoring organs 6 increase the depth c of the separating groove between two following cutting edges separated by an interval T always by the amount Δc so that just in front of each cutting edge 5 the separating groove in the wood H shows with regard to the cylindrical inner wall 1*c* of the knife ring 1 a depth c+Δc. This depth of the separating groove always increased by Δc makes it possible for the cutting edges 5 to peel off a thin layer having a thickness Δc=d. Consequently, the thickness d of the peeled off wood layers is analogous to the advance speed $v_v$ if the knife rim 1 and consequently the scoring progressions Δc in the separating grooves of the wood correspond to the flaking progressions at the knife edges 5.

When leaving the knife ring 1, the peeled off wood layers are transformed into thin wood flakes whose uniform lengths and thicknesses are defined by the described construction parameters Δc and L whereby their widths (cross to the wood grain) result more or less by chance from the specific rupture behaviour along the wood grain and caused by the forced deviation in the outlet channels 19.

FIG. 2 illustrates the knife set 2 during the dressing step. During this procedure the knife rim 1 gets arrested respectively in a position in which the rotating grinding drum 20 exactly touches a cutting edge 5 and carries out small axial movements. Thereby the very thin residues remaining on the width b of the ring grooves 21 after the resharpening are ground off. At the same time the ridge 6*b* of the scoring organ 6 gets resharpened correspondingly. So this phase effects a smoothing which has to be carried out for each knife set 2 individually. For that purpose the knife rim 1 is respectively maintained in the position in which the grinding drum 20 touches the cutting edge 5 of the knife plate 3 by means of the said arresting bolt slid through the arresting boring 1*b*.

FIG. 3 illustrates a knife set 2' according to the known State of the Art whereby the scoring blade 7' is arranged exchangeably in a blade holder 10'. Its effective scoring organ 6' also follows the cutting edge 5 whereby it shows a slight straight ascent opposed to the direction of rotation of the knife rim 1. Due to this feature, the effective scoring organ 6' penetrates into the wood with a drawing movement but it is subject to rapid wear which not only increasingly impairs the quality of the produced flakes but also makes it necessary to often carry out the time consuming change of the scoring blades 7.

FIG. 4 shows a perspective view of the knife set 2 designed according to the invention, that means with the scoring blade 7 tightly fastened at regular intervals L to the back 8 of the knife plate 3. The specialist will know several proven methods for this tight fastening as e.g. snug fit or thermic shrinking seat in correspondingly prepared grooves on the back 8 of the knife plate 3. The guiding plates 10 allocated to the knife sets 2 are provided with corresponding slots 14 for the sliding guidance of the scoring blades 7.

FIG. 4A serves to explain the scoring geometry and shows a very enlarged perspective view of a scoring organ 6 according to the invention as it is always regenerated by sharpening by the two described sharpening phases in the outer area of the scoring blades 7. The scoring organ 6 has two lateral flanks 6*a* which are inclined towards each other according to the groove angle β of the grinding drum 20 (see FIG. 5*a*). They form a ridge 6*b* which begins tangentially to the cutting edge 5 at the face 4 of the knife plates 3 with a base width b and tapers continuously when rising up to the scorer tip 6*c* in a concave line which corresponds to the radius r of the grinding drum 20. Thereby the base width b of the scoring organ 6 is smaller than the thickness a of the scoring blade 7 so that on both sides of the scoring organ 6 small marginal strips 6*d* result thereof at the scoring blade 7 which are concavely curved in accordance with the radius $R_1$ of the common circle $K_1$ formed by the cutting edges 5.

When the knife sets 2 are mounted in the knife rim 1, the scorer tips 6*c* protrude towards the interior over the common circle $K_1$ formed by the cutting edges 5. But, as already explained at FIG. 1A, the scoring progression Δc is analogous to the flaking progression defined by the flake thickness d, so only the hatched part of the scoring organ 6 penetrates permanently and actually scoring into the wood by an amount Δc. Immediately after the scoring by the depth Δc, the prescored width $b_1$ of the separating groove is widened to its maximum width b by the lateral flanks 6*a* of the following scoring organ 6 and in the same time both V-shaped groove walls are densified and smoothed. Thereby in a first phase both sharp ridge edges 6*e* scrape along the scored groove walls and then both lateral flanks 6*a* widen the prescored groove little by little up to its maximum width b when densifying and smoothing its lateral walls. So the scoring is achieved by the fact that the scoring organs 6 are always rotating in the V-shaped separating grooves of the wood whereby the depth is always increased by an amount Δc and thereby they densify and smooth the lateral walls of the groove. That is why the thin flakes peeled off by the cutting edges 5 with a thickness d=Δc have densified and smooth borders on the two small sides extending cross to the fiber structure.

This additional effect of the scoring organs 6 according to the invention is of considerable importance for the quality of the produced flakes. As during the scoring into the wood, the wood fibers are rather torn than cut, in the past the lateral walls of the scored separating grooves got uneven surfaces which make the flakes peeled thereof having tapered fibrous borders. The scoring organ 6 according to the invention also mostly tears the wood fibers but the adverse consequences for the produced flakes and their further processing are immediately restored by the scoring organ 6 itself due to the subsequent densifying and smoothing of the groove walls. The extremely enlarged illustration of the scoring organ 6 in FIG. 4A should not obscure the fact that the processes in question concern very small dimensions in very short time intervals. During tests, the following dimensions of the scoring organs 6 have proved to be suitable to produce flakes with a thickness of 0.6 mm.

Δc=d=0.6 mm; c=3×Δc=1.8 mm b=2×Δc=1.2 mm; a=3 mm; f=18 mm.

FIG. 5 shows a grinding drum 20 with ring grooves 21 having a profile determined by the width b, the depth c and the angle β, which profile is determinant for the shape of the scoring organs 6 and consequently for the V-shaped separating grooves in the wood as it is obvious from the enlarged illustration in FIG. 5A.

The grinding device 22 illustrated by FIG. 6 consists essentially of a grinding drum 20 connected to the drive motor 24 via the belt drive 23 and fastened onto the grinding support 25. Due to a cross sliding carriage 26,27 the support can be moved in two directions which is in radial direction during the first grinding phase (sharpening phase) according to the pre-programmed radial grinding advance and then, during the second grinding step (dressing phase), by slight oscillation in axial direction. The pre-programmed radial grinding advance of only a few tenths of a millimeter is controlled by a special drive 28 whose drive mechanism is protected by an expansion bellow collar 29. The grinding device 22 is mounted onto an apparatus carriage 30 on both sides equipped with guiding ledges 31 and equipped in the middle with a connection shackle 32*a* for the hydraulic pushing sytem 32 as illustrated by FIG. 8.

Furthermore the apparatus carriage 30 carries at the side an adjusting device 33 with a position switch 33*a,* a knife stop 33*b* and a spacer shim 33*c* which collaborate with the setting device 35 illustrated by FIG. 7 for the advancing of the knife sets 2 made necessary by the wear. The adjusting device 33 is shown on a larger scale in FIG. 7A to facilitate the understanding of its working principle when it advances precisely the worn out knife sets 2.

The setting device 35 shown by FIG. 7 is mounted on a vertical tool carrier 34. It consists of a screw spindle 36, a knife pushing bolt 37 and a hold-down device 38. All tools 36, 37, 38 can be actuated individually by a pneumatic unit controlled by an automatic program. In so far, the invention uses the setting device 35 described in U.S. Pat. No. 5,525,094 and which is there part of a separate sharpening apparatus allowing the restoration of knife rims removed from the flaker and whose knife sets act in one dimension.

As the interior of the knife rim 1 of flakers for long logs and wood cut to length is free of built-in components and therefore is suitable to receive the sharpening device 22 it is possible to further develop the invention so that the resharpening of the knife sets 2 can be carried out directly in the flaker 39. For that purpose the setting device 35 has been arranged onto the machine support 46 at the side of the machine housing 40 whereby the machine support 46 is movable backward and forward on the sliding rails 47 during the operation of the flaker. To make the access to the periphery of the knife rim possible for the tools 36, 37, 38, the machine housing 40 has a small opening 41 at the side which can be closed by a lid 42 sliding in vertical guiding ledges 43. A cylinder-piston-unit 44 cares for the opening and closing movements of the lid 42.

The bottom plate 45 of the tool carrier 34 is guided sliding on the machine support 46 by means of horizontal guiding ledges 48 whereby it is brought in working position by a movement cross to the machine axis generated by a hydraulic pushing system 49.

The FIGS. 8, 9 and 10 show a flaker 39 in the station for sharpening 50 which is located at the side of a feed trough 51 providing the wood supply to the flaker 39. As already mentioned, during the flaking process the flaker 39 is movable to and fro on its support 46 along the slide rails 47 in front of the feed trough 51. Before the flaker 39 can be moved to the station for sharpening 50, the stationary retaining device 52 must first be swivelled back from the flaker 39 into the feed trough 51 as it can be seen from the plan view FIG. 9.

In the station for sharpening 50, a tool column 53 is arranged in front of the flaker 39 whereby the tool column 53 is covered by a column table 54. On this column table 54 the tool carriage 30 can be slid parallel to the axis into the free interior of the knife rim 1 by means of the hydraulic pushing system 32. To ensure a stable holding of the sharpening apparatus 22 during the sharpening procedure, the two lateral guiding ledges 31 of the tool carriage 30 move thereby under the two borders of the column table 54.

FIGS. 11 and 12 illustrate a further embodiment of the invention comprising a flaking installation with two stations for sharpening 50*a* and 50*b* located respectively on each side of a working station 50*c*. Two similar flakers 39*a* and 39*b* are mounted together with their machine supports 46 and slide rails 47 on a common sliding platform 55 which can be moved horizontally on the slide rails 56 by means of the hydraulic drive 57. In the situation illustrated by the figures, the flaker 39*a* is just being processed in the station for sharpening 50*a* whereas the flaker 39*b* is in working position 50*c*.

According to the present invention the resharpening of the knife sets 2 mounted in the knife rim 1 is done as follows:

In a first step the knife sets 2 are advanced towards their area of function, that means to the inside, by an amount commensurate with their respective wear. Experience has shown that an advancing by 0.5 mm is sufficient. For that purpose the knife ring gets arrested step by step in a position in which the tools 36, 37,38 of the setting device 35 can reach the respective knife sets 2 and their holding systems 12, 13 in order to make a given advancing of the knife sets 2 possible. This arresting of the knife rim 1 step by step is done by means of the arresting borings 1*b* allocated to each knife carrier 13 and into which said stationary arresting bolt already mentioned in U.S. Pat. No. 5,525,094 (Pos. 13 in FIG. 2) snaps in successively.

When the knife rim 1 is arrested in such a position, the screw spindle 36 is pneumatically actuated in such a manner that the clamping screws 12 distributed axially along the knife carriers 13 are loosened one after the other. In the same time the position switch 33*a* of the adjusting device 33 is pneumatically moved in radial direction until it leans against the wear shoe 17, resp. the pressure lip 18 adjacent to the knife set in question. The radial distance between the position switch 33*a* and the hereto allocated knife stop 33*b* adjustable by means of the spacer shims 33*c* prescribes the distance over which the knife set 2 in question has to be advanced, that means generally 0.5 mm. Now the knife pushing bolt 37 and the hold-down device 38 are actuated pneumatically and the concerned knife set 2 in the knife rim 1 is pushed towards the inside until the face 4 of the knife plate 3 leans against the knife stop 33*b*. Now the knife set 2 is fixed in that advanced position by retightening the clamping screws 12 by means of the screw spindle 36. Then the knife rim 1 is rotated by one knife interval T after retraction of the setting tools 36, 37 38 and the position switch 33*a* and after the arresting bolt has been removed from the corresponding boring 1*b*. After the knife rim 1 has been arrested again the next knife set 2 is advanced as already described. This procedure is repeated until all knife sets 2 are uniformly advanced. As the knife sets 2 may show a slightly different state of wear, the degree of wear measured one after the other at the wear shoes 17 resp. at the pressure lips 18 by the position switch 33*a* is recorded electronically to calculate an average value which is memorized in the program for the radial sharpening advance of the sharpening device 22.

After all knife sets have been advanced in the described manner, the actual sharpening procedure begins with the first grinding phase. Thereby the knife rim 1 as illustrated by FIG. 1 rotates slowly while the grinding drum 20 is advanced radially towards the knife rim, the ring groves of said grinding drum 20 being congruent with the scoring organs 6. As soon as the grinding drum gets in contact with the advanced knife sets 2, it takes up a torque which increases the power consumption of its drive motor 24 which serves as control pulse to signal the beginning of the programmed grinding advance to the automatic control. This induces the program controlled special drive 28 to gradually move the grinding device 22 radially against the advanced knife sets 2.

This grinding advance of just some tenths of a millimeter is determined by two programming parameters. These are on the one hand the degree of wear measured by the position switch 33*a* at the wear shoes 17, resp. at the pressure lips 18 and based on which an average wear value is calculated and on the other hand the protrusion $\Delta c$ of the cutting edge 5 defining the required flake thickness d.

As the grinding drum 20 gets worn out gradually, the actual diameter 2*r* of the grinding drum is determined after each sharpening procedure by a trimming device (not shown) and entered into the advancing program as additional correction factor.

As soon as the preprogrammed radial grinding advance is depleted, the knife rim 1 is stopped. Now the sharpened cutting edges 5 show the required protusion $\Delta c$ over the cylindrical inner wall 1*c* of the knife rim 1 whereby in the same time the lateral flanks 6*a* of the scoring organ 6 are also ground by the ring grooves 21 of the grinding drum 20.

As after the first grinding phase residues remain on the cutting edges 5 in the area of the ring grooves 21 over their width b, these residues must be ground away in an additional grinding phase. For that purpose the knife rim 1 is arrested step by step by means of the arresting borings 1*b* and the said arresting bolt in the positions in which the grinding drum 20 touches the cutting edge 5 as illustrated by FIG. 2. As when the grinding drum touches the cutting edges 5 it makes slight axial movements it grinds off said residues from the cutting edges 5 whereby the grinding drum in the same time also reduces the scoring ridge 6*b* of the scoring organs 6 according to their radius r so that the resharpened knife sets 2 show again their original condition.

After the removal of the knife ring from the flaker the described sharpening procedure can be carried out in a special sharpening device as already proposed in U.S. Pat. No. 5,525,094 but it can also be carried out inside of the flaker as illustrated by FIGS. 8 to 12.

As obvious from FIG. 9, for the resharpening in the flaker the flaker 39 must be moved from its working position in front of the feed trough 51 to the sharpening position 50. But for that purpose the retaining device 52 must first be swivelled out of the machine 39 into the feed trough 51. Since the energy consumption of the flaker rises abruptly the more the knife sets 2 become dull, the rapid increase of the power consumption of the drive motor indicates that it is very urgent to resharpen the knife sets 2 and therefore it can be used as initiating pulse to stop the drive motor and to move the flaker 39 to the sharpening position 50. There the sharpening apparatus 22 held ready on the column table 54 of the tool column 53 is slid into the free interior of the knife rim 1. At the same time, the small door 41 at the side of the machine housing 40 is opened and the setting device 35 slid from its position of rest to its working position shown in FIG. 7. In that position, the setting device 35 provides the previously described advancing of the knife sets 2 within the machine housing 40.

After completion of the described sharpening procedure, the sharpening device 22 is moved out of the knife rim, the setting device 35 is brought back into its position of rest and the small door 41 gets closed. Now the flaker 39 with the restorated knife rim can be moved back into its working position in front of the feed trough 51.

The resharpening of the knife sets 2 takes a lot of time and consequently means a corresponding loss of production. This can be completely avoided by arranging two flakers 39*a* and 39*b* onto a common sliding platform 55 as illustrated by FIGS. 11 and 12. So one flaker is in the station of work 50*c* while the other flaker gets restored in one of the two sharpening stations 50*a* or 50*b*.

Considering all these facts, the invention offers the possibility of a fully automatic flaking operation working with best sharpened knife sets 2 over quite a long period of time without interruption of the production and so to continuously produce a constant high quality flake without the need for intervention of maintenance personnel. With a grind-off margin of 50 mm for the knife sets 2, approx. 100 sharpening procedures can be carried out before the knife rim 1 has to be replaced.

I claim:

1. Resharpening apparatus for knife sets of flakers having a two-dimensional cutting sequence for producing thin flakes from long logs and wood cut to length, said knife sets being evenly distributed around a rotatable knife rim and having a plate shaped flaking knife with a cutting edge oriented radially inward and parallel to an axis of rotation for said knife rim, said flaking knives being followed in rotation by generally axially equidistant spaced scoring blades extending from each of said respective flaking knives and having effective areas protruding radially inward with respect to said flaking knives, the resharpening apparatus comprising:

a rotatable grinding drum having an axial length adapted for corresponding to said flaking knives; and a plurality of ring grooves circumscribing said grinding drum; said ring grooves having generally equidistant axial spacing adapted for corresponding to that of said scoring blades and a having a profile adapted for corresponding to that of said effective area of said scoring blades;

whereby resharpening of the knife sets remaining in the knife rim is carried out by moving said grinding drum in radial and axial directions with respect to the knife sets.

2. Apparatus according to claim 1, wherein said grinding drum and said effective profile of said ring grooves are adapted for forming said scoring blades having a ridge which is generally flat proximate the flaking knife and having a base width, the ridge tapering continuously with diminishing radius of the grinding drum thereby forming a rising concave line up to a scorer tip, whereby scoring blade thickness is greater than the base width of the ridge.

3. Apparatus according to claim 2, wherein during resharpening of the knife sets, the knife rim remains within the flaker, the resharpening apparatus further comprising:

a sharpening station being located laterally with respect to a working station having a feed trough adapted for guiding said long logs and said wood cut to length to the flaker, said sharpening station including an advancing device adapted for displacing the knife sets radially inward according to wear on the knife sets, said grinding drum, and a setting device adapted for loosening and securing the knife sets with respect to the knife rim.

4. Apparatus according to claim 3, wherein said grinding drum is moved radially and axially within a radial interior of the knife rim at said sharpening station, and said advancing and setting providing an advancing of the knife sets according to their wear has an devices access the knife sets through a radially outer opening in the flaker.

5. Apparatus according to claim 4, further comprising:

sharpening stations being arranged on opposite sides of the working station, provided with a feed trough whereby two similar flakers are installed on a common sliding platform and each flaker is slidable to a respective one of said sharpening stations.

6. A method for resharpening two-dimensionally acting knife sets, said knife sets being evenly distributed around a rotatable knife rim and having a plate shaped flaking knife with a cutting edge oriented radially inward and parallel to an axis of rotation for said knife rim, said flaking knives being followed in rotation by generally axially generally axially equidistant spaced scoring blades extending from each of said respective flaking knives and having effective areas protruding radially inward with respect to said flaking knives, the method comprising:

advancing the knife sets according to an extent of their wear, rotating a grinding drum having a ring groove congruent with each scoring blade while continuously rotating the knife rim, rotating said knife rim intermittently so that said grinding drum touches each cutting edge one after another, and axially moving said rotating grinding drum with respect to said cutting edges when the knife rim is intermittently arrested.

7. The method according to claim 6, further comprising:

detecting increased power consumption of a drive rotating the knife rim caused by wear on the knife sets, whereupon fully automatic programmed control is started for resharpening the knife sets.

* * * * *

UNITED STATES PATENT AND TRADEMARK OFFICE

CERTIFICATE OF CORRECTION

PATENT NO. : 5,823,856
DATED : October 20, 1998
INVENTOR(S) : Wilhelm PALLMANN

It is certified that error appears in the above-identified patent and that said Letters Patent is hereby corrected as shown below:

Claim 4, column 12, lines 22-23, please delete the following phrase: "providing an advancing of the knife sets according to their wear has an"

Claim 5, column 12, line 27, please delete the following phrase: "provided with a feed trough"

Signed and Sealed this

Twenty-ninth Day of June, 1999

*Attest:*

Q. TODD DICKINSON

*Attesting Officer*

*Acting Commissioner of Patents and Trademarks*